US007529514B2

(12) United States Patent
Tamura et al.

(10) Patent No.: US 7,529,514 B2
(45) Date of Patent: May 5, 2009

(54) IMAGE FORMING APPARATUS WITH MULTIPLE IMAGE HEATING NIP PORTIONS

(75) Inventors: Masashige Tamura, Toride (JP); Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 11/838,984

(22) Filed: Aug. 15, 2007

(65) Prior Publication Data

US 2007/0292176 A1 Dec. 20, 2007

Related U.S. Application Data

(62) Division of application No. 11/275,124, filed on Dec. 13, 2005, now Pat. No. 7,395,021.

(30) Foreign Application Priority Data

Dec. 13, 2004 (JP) ..... 2004-360035
Dec. 14, 2004 (JP) ..... 2004-361485

(51) Int. Cl.
*G03G 15/02* (2006.01)

(52) U.S. Cl. ..... 399/328; 399/341

(58) Field of Classification Search ..... 399/328, 399/329, 341
See application file for complete search history.

(56) References Cited

U.S. PATENT DOCUMENTS

| | | | | |
|---|---|---|---|---|
| 4,928,148 | A * | 5/1990 | Higashi | 399/328 |
| 5,296,904 | A * | 3/1994 | Jackson | 399/328 |
| 5,408,301 | A * | 4/1995 | Tokishige et al. | 399/321 |
| 6,743,502 | B2 | 6/2004 | Ogino et al. | 428/332 |
| 6,853,832 | B2 * | 2/2005 | Noya et al. | 399/328 |
| 7,324,779 | B2 * | 1/2008 | Anderson et al. | 399/341 |
| 2002/0037176 | A1 | 3/2002 | Ogino et al. | 399/68 |

FOREIGN PATENT DOCUMENTS

| | | |
|---|---|---|
| JP | 61-256367 | 11/1986 |
| JP | 4-344680 | 12/1992 |
| JP | 5-158364 | 6/1993 |

(Continued)

OTHER PUBLICATIONS

English Abstract of JP 07-191564 A.*

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

An image forming apparatus has an image forming unit for forming a toner image on a recording material, a first image heating unit having a first rotary member and a second rotary member forming a first nip therebetween, and a second image heating unit provided with a third rotary member forming a second nip between it and the first rotary member. The first rotary member, second rotary member and third rotary member respectively has a heater and an introducing unit introduces the recording material heated in the first nip into the second nip. A recording material separation temperature of the second image heating unit is lower than the recording material separation temperature of said first image heating unit, and when the toner image is heated in the second nip, the second rotary member heats the first rotary member.

5 Claims, 11 Drawing Sheets

FOREIGN PATENT DOCUMENTS

| | | | |
|---|---|---|---|
| JP | 5-216322 | | 8/1993 |
| JP | 07191564 A | * | 7/1995 |
| JP | 11-174744 | | 7/1999 |
| JP | 2002-91046 | | 3/2002 |
| JP | 2002-365967 | | 12/2002 |
| JP | 2004-4260 | | 1/2004 |
| JP | 2004-151259 | | 5/2004 |

* cited by examiner

| FIG. 5A | FIG. 5B |
|---|---|

IMAGE FORMING APPARATUS WITH MULTIPLE IMAGE HEATING NIP PORTIONS

This application is a divisional of U.S. patent application Ser. No. 11/275,124, filed Dec. 13, 2005.

BACKGROUND OF THE INVENTION

1. Field of the Invention

This invention relates to an image forming apparatus for forming a toner image on a recording material, and an image forming method of forming a toner image on a recording material. As examples of this image forming apparatus, mention can be made of a printer, a copying machine, a facsimile apparatus, a compound machine, etc. Also, this image forming method is used in a printer, a copying machine, a facsimile apparatus, a compound machine, etc.

2. Related Background Art

In recent years, color printers and color copying machines utilizing a digital type electrophotographic printing method have been spread because of an increase in uses for forming color images. Also, recently, the quality of the color images has been improved and moreover, the use thereof as the image outputs of digital still cameras of which the expanse of the market is conspicuous has been increased. Thus, as an image forming apparatus such as a printer or a copying machine utilizing the electrophotographic printing method or the like, there has become required one capable of outputting an image of an ordinary quality and in addition, capable of outputting an image of such a high glossy quality as compares with a silver salt photograph.

An image forming method for obtaining such a color image excellent in gloss is proposed in Japanese Patent Application Laid-open No. H05-216322 and Japanese Patent Application Laid-open No. 2002-91046. This image forming method fixes a toner image on a recording material by a roller fixing device, and thereafter effects the reheating of the toner image on the recording material by a belt fixing device. Then, the recording material moved while being in close contact with a belt is cooled and then separated, whereby a highly glossy image is formed.

In the above-described conventional construction, however, to form a highly glossy toner image, a roller fixing device comprising a pair of rollers becomes necessary besides the belt fixing device, and this leads to the problem that the apparatus becomes bulky or complicated.

SUMMARY OF THE INVENTION

It is an object of the present invention to provide an image forming apparatus which can effect the formation of a highly glossy toner image by a simple construction.

It is also an object of the present invention to provide an image forming apparatus having:

image forming means for forming a toner image on a recording material;

image heating means for heating the toner image on the recording material in a nip portion, the image heating means having a rotary member contacting with the front surface of the recording material in the nip portion, and a belt contacting with the rear surface of the recording material;

means for reversing the front surface and rear surface of the recording material heated in the nip portion, and reintroducing the recording material into the nip portion; and cooling means for cooling the recording material after reintroduced moving while keeping contact with the belt before the recording material is separated from the belt.

It is another object of the present invention to provide an image forming method of forming a high-gloss toner image on a recording material by the use of a rotary member and a belt forming therebetween a nip portion for heating a toner image formed on the recording material, and cooling means for cooling the recording material moving while keeping contact with the belt, having:

a step of forming a toner image on the recording material;

a step of introducing the recording material into the nip portion so that the toner image on the recording material may contact with the rotary member;

a step of heating the toner image on the recording material introduced into the nip portion;

a step of reversing a front surface and a rear surface of the recording material heated in the nip portion, and reintroducing the recording material into the nip portion so that the toner image on the recording material may contact with the belt;

a step of reheating the recording material reintroduced into the nip portion;

a step of cooling the recording material moving while keeping contact with the belt by the cooling means; and a step of separating the cooled recording material from the belt.

It is still another object of the present invention to provide an image forming method of forming a high-gloss toner image on a first side of a recording material and a low gloss toner image on a second side of the recording material by the use of a rotary member and a belt forming therebetween a nip portion for heating a toner image formed on the recording material, and cooling means for cooling the recording material moving while keeping contact with the belt, having:

a step of forming a toner image on the first side of the recording material;

a step of introducing the recording material into the nip portion so that the toner image on the recording material may contact with the rotary member;

a step of heating the toner image on the recording material introduced into the nip portion;

a step of reversing a front surface and a rear surface of the recording material heated in the nip portion, and forming a toner image on the second side of the recording material;

a step of reintroducing the recording material into the nip portion so that the toner image formed on the first side of the recording material may contact with the belt;

a step of reheating the recording material reintroduced into the nip portion;

a step of cooling the recording material moving while keeping contact with the belt by the cooling means; and a step of separating the cooled recording material from the belt.

It is yet still another object of the present invention to provide an image forming apparatus having:

image forming means for forming a toner image on a recording material;

image heating means for heating the toner image on the recording material, the image heating means having first image heating means provided with a first rotary member and a second rotary member forming a first nip therebetween, and second image heating means provided with a third rotary member forming a second nip between it and the first rotary member; and means for introducing the recording material heated in the first nip into the second nip;

wherein a recording material separation temperature from the second image heating means is lower than the recording material separation temperature from the first image heating means.

Further objects of the present invention will become apparent from the following detailed description when read with reference to the accompanying drawings.

DESCRIPTION OF THE PREFERRED EMBODIMENTS

First Embodiment

Figure 1:
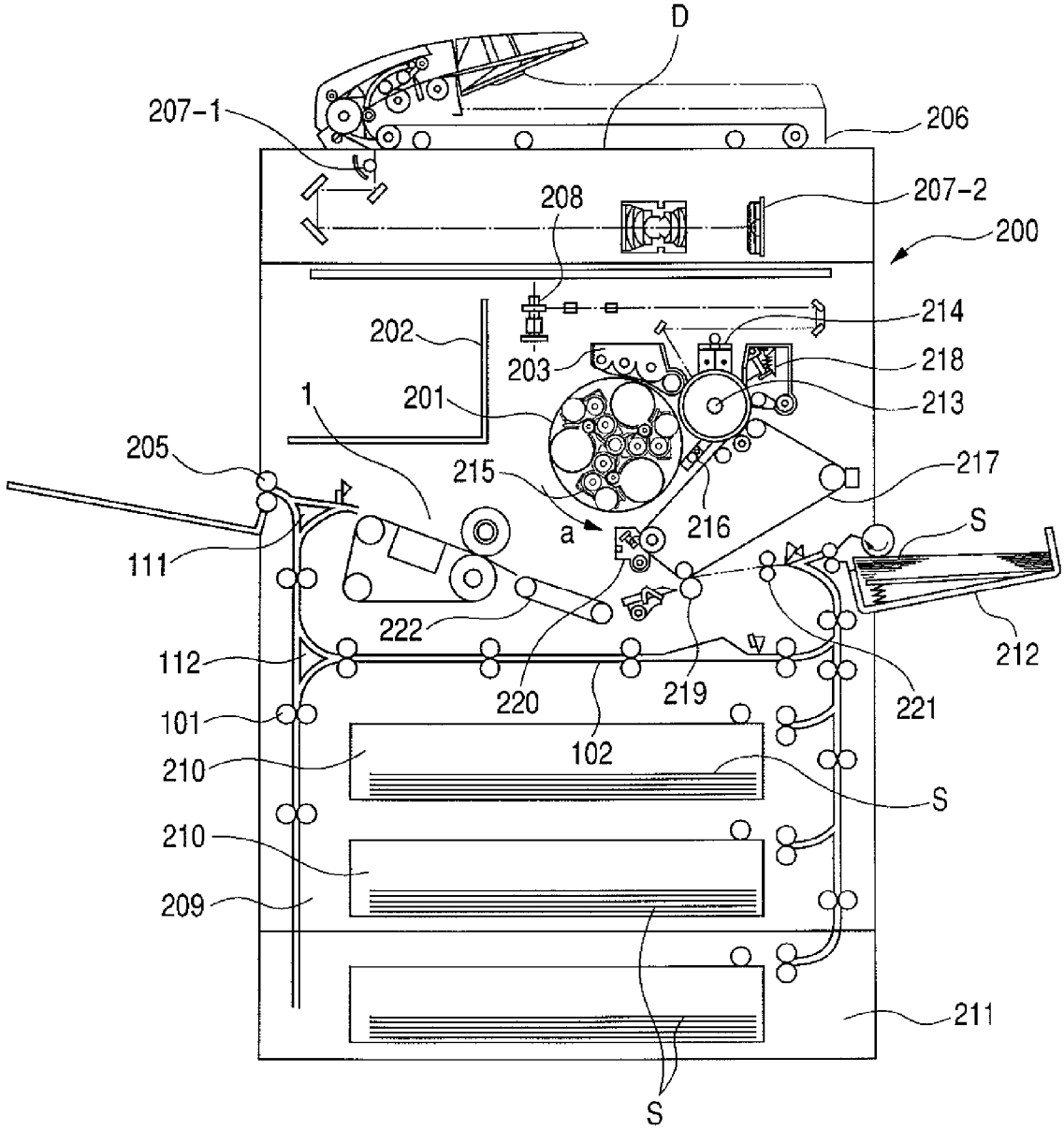
FIG. 1 is a cross-sectional view of the essential portions of a multi-color image forming apparatus.

FIG. 1 shows an example of an image forming apparatus.

An apparatus main body 200 shown in FIG. 1 is a multi-color image forming apparatus (color copying machine) having a fixing apparatus 1 as an image heating apparatus. Even if the image forming apparatus is a monochromatic one, the purport thereof does not differ in any way.

The apparatus main body 200 is provided with an original plate 206, a light source 207, a lens system 208, a sheet feed portion 209, an image forming portion 202, etc. The sheet feed portion 209 has cassettes 210, 211 and a manually feeding cassette 212 containing recording materials therein and detachably mountable on the apparatus main body 200, and the recording materials are supplied from these cassettes 210, 211 and the manually feeding cassette 212. In the image forming portion 202, there are disposed a singly constructed black developing device 203, a cylindrical photosensitive drum 213, a primary charger 214, a rotary developing device 201 containing therein a plurality of developing devices 215 integral with a toner cartridge, a post-charger 216 for adjusting the quality of image after development, an endless ring-shaped transfer belt 217 to which toner images of four colors are superposed one upon another and transferred and thereafter, from which a multi-color image is transferred to the recording material, a drum cleaner 218 for removing any residual toners on the photosensitive drum, a secondary transfer roller 219 for transferring the toner images from the transfer belt to the recording material, and a belt cleaner 220 for removing any residual toners on the transfer belt. Upstream of the image forming portion, there are disposed registration rollers for enhancing the accuracy of the posture and position of the recording material, and feeding out the recording material in well-timed relationship with the toner images on the transfer belt, and downstream of the image forming portion, there are disposed a transferring and conveying apparatus 222 for conveying the recording material S to which the toner image has been transferred, the fixing apparatus 1 which is most characteristic and which fixes the unfixed image on the recording material S, and discharge rollers 205 for discharging the recording material S on which the image has been fixed out of the image forming apparatus.

The operation of this image forming apparatus will now be described.

When a sheet feeding signal is outputted from a control device, not shown, provided on the apparatus main body 200 side, the recording material S is supplied from the cassette 210 or 211 or the manually feeding cassette 212. On the other hand, light applied from a light source 207-1 to an original D placed on the original plate 206 and reflected therefrom is once read by a CCD unit 207-2, and thereafter is converted into an electrical signal and is replaced by a laser beam from a laser scanner unit 208, and is applied onto the photosensitive drum 213. The photosensitive drum 213 is charged in advance by the primary charger 214, and by the light being applied thereto, an electrostatic latent image is formed thereon, and then a toner image of a selected color is formed thereon by the black developing device 203 and the plurality of developing devices 215 disposed in the rotary developing device 201.

The toner image formed on the photosensitive drum has its potential adjusted by the post-charger 216, and is soon transferred onto the transfer belt 217 at a transferring position. As regards the transferred toner image, in the case of a color mode, the transfer belt is further rotated by one rotation so that the next toner image may be formed and transferred. In the meantime, the rotary developing device 201 is rotated in the direction of arrow a so as to oppose a developing device of the next designated color to the photosensitive drum 213 to thereby prepare for developing the next electrostatic latent image. In this manner, in a full-color mode, the forming and developing of the electrostatic latent image, and the transfer of the developed image are repeated until a predetermined number of toner images are transferred.

Now, the recording material S fed from the sheet feeding portion 209 has its skew conveyance corrected by the registration rollers 221, and further is timed and fed to the image forming portion 202. Then, the toner images are transferred to the recording material S by the secondary transfer roller 219, and the separated recording material S is conveyed to the fixing apparatus 1 by the conveying apparatus 222, and the unfixed transferred image is permanently fixed on the recording material S by the heat and pressure of the fixing apparatus 1. The recording material S on which an image has been fixed is discharged from the apparatus main body 200 by the discharge rollers 205.

The recording material S fed from the sheet feeding portion 209 has an image formed thereon in this manner and is discharged.

Also, the image forming apparatus 200 has a both-side image forming function. This both-side image forming operation will hereinafter be described on the basis chiefly of the conveyed state of the recording material S. The recording material S after the termination of the fixing on a first side by the fixing apparatus 1 is conveyed to a reversal conveying path 101 branched off downwardly by a reversal flapper mechanism designated by 111 and disposed downstream of a reversal branch-off point. Next, the recording material S switch-back-reversed by the reversal conveying path 101 in a state in which the front side and back side thereof have been reversed is bifurcated by a both-side flapper mechanism 112, and is drawn into a both-side conveying path 102 and is refed to the image forming portion. Incidentally, if the recording material S is discharged from the reversal conveying path 101 with its front surface and rear surface reversed, by the discharge rollers 205, the image forming apparatus functions as a reversal discharging mode.

The recording material S thus reconveyed by the reversal conveying path 101 and the both-side conveying path 102 is soon refed to the registration rollers 221. Thus, a toner image is formed on a second side of the recording material S. The other image forming process and the conveying process of the recording material S differ in no way from those in the aforedescribed one-side image forming mode and therefore need not be described herein.

Figure 2:
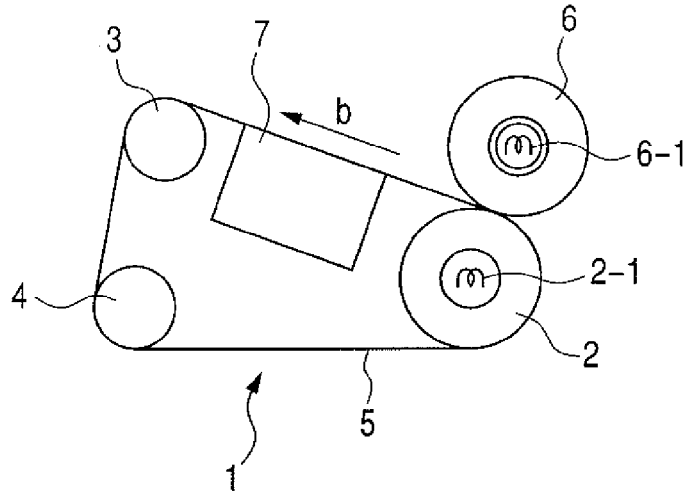
FIG. 2 is a cross-sectional view of the essential portions of a fixing apparatus.

FIG. 2 shows a cross section of the essential portions of the fixing apparatus 1 which is most characteristic in the present embodiment.

The fixing apparatus 1 has a heating roller 6 as a heating rotary member, and a belt member 5, and these are disposed in pressure contact with each other so as to form a nip portion therebetween.

The heating roller 6 comprises a cylinder roll made of a metal having high heat conductivity, and an elastic layer (e.g. a silicone rubber layer having JIS-A rubber hardness of the order of 40°) and a mold releasing layer (e.g. a tube made of a fluorine resin such as PFA) formed so as to coat the cylinder roll, and has a halogen heater 6-1 as a heat source for heating the heating roller disposed in the roll, and is designed to be capable of functioning as a heating roller and at the same time, acting as a pressure roller.

In the case of the present embodiment, the controlled temperature of the heating roller 6 is set to 200 degrees, and a good fixing property is secured even when a four-color toner image is fixed. The controlled temperature of the fixing apparatus is not restricted thereto, and the number of the developing apparatuses (the kinds of the toners) is of course not restricted thereto.

Also, the belt member 5 comprises a belt base member formed of polyimide film having a thickness of the order of 75 μm or the like, and a mold releasing layer (e.g. a PFA tube having a thickness of 30 μm formed thereon, and is rotatively driven in the direction of arrow b. During a normal fixing operation, it acts as a pressure belt and is brought into pressure contact with the heating roller 6, and urges the recording material S against the heating roller 6 to thereby secure a good fixing property. That surface of this belt member 5 which contacts with the image is made into a smooth surface, and contributes to improving the degree of gloss of the image.

Description will first be made of the operating action when an image of normal low gloss and an image of non-gloss are fixed. The recording material S bearing thereon an unfixed toner image formed by the image forming portion is introduced into the nip portion so that the toner image may contact with the heating roller 6. At that time, the toner image on the recording material is heated and pressurized in the nip portion, whereby the unfixed toners are melted and the toner image is fixed as a permanent toner image on the recording material.

Next, the fixing apparatus 1 also has a construction for obtaining a highly glossy image of high quality. The construction of the belt member 5 will now be described in a little greater detail with reference to FIG. 2. As shown in FIG. 2, the belt member 5 is passed over such suspension rollers as a heating roller 2 discrete from the aforedescribed pressure roller 6, a strip-off roller 3 and a steering roller 4. Also, the aforedescribed heating roller 6 has the function of pressing the belt member 5 toward the heating roller 2 to thereby form a nip portion between it and the belt member. There is also provided a cooling apparatus 7 or the like for cooling that region of the belt member 5 which is downstream of the nip. This cooling apparatus sufficiently cools the recording material moving while keeping close contact with the belt member before it is separated from the belt member.

The heating roller 2 comprises a cylinder roll made of a metal having high heat conductivity and coated with a mold releasing layer (e.g. a tube made of a fluorine resin such as PFA), and has a halogen heater 2-1 disposed in the roll. The strip-off roller 3 is for stripping off the recording material S from the belt member 5 by its own rigidity. The configurational dimensions of this roller 3 is determined by the adhering force between the belt member 5 and the recording material S, and the twining angle of the belt member 5 onto the strip-off roller 3. The steering roller 4 is for adjusting the movement direction of the belt member 5 in order to prevent the end portion of the belt member from being damaged by inclined movement occurring during the rotation of the belt member 5. Specifically, design is made such that one shaft of the roller 4 is positionally fixed and the other shaft thereof is displaced by a displacing mechanism, not shown, so as to be inclined with respect to the axis of the heating roller 2.

The belt member 5 comprises endless film (75 μm or greater) made of thermosetting type polyimide coated with a surface layer (30 μm or greater) of silicone rubber or the like having a smooth surface. The cooling apparatus 7 is actually for cooling the recording material S being in close contact with the belt member 5. This cooling apparatus 7 is disposed on the inner peripheral surface area of the belt member 5 which is between the heating roller 2 and the strip-off roller 3, and contacts with that inner peripheral surface and absorbs the heat of the belt member 5, and is constituted by e.g. a radiating plate or the like. The cooling target temperature of this cooling apparatus 7 differs depending also on the kind of the toners used or of the image receiving layer or the like of the recording sheet, but generally is such a temperature that the temperature of the recording material S on the belt member 5 becomes 60-80 degrees.

Figure 3A:
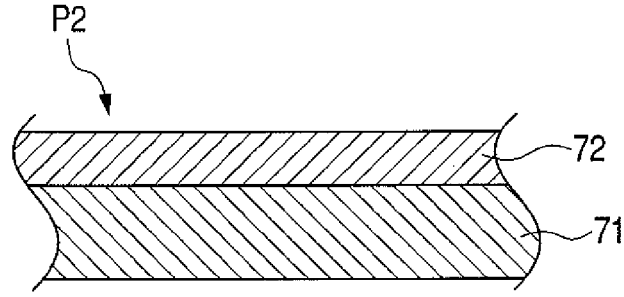
FIG. 3A is a schematic cross-sectional view showing a recording sheet for gloss output.

Description will now be made of the operation of fixing a high-gloss image by the fixing apparatus 1. First, in the present embodiment, the following method is adopted as a technique of obtaining a high-gloss image. When an operator requesting for an output desires the output of a high-gloss image, use is made preferably of a recording material S for a high-gloss image output. As this recording material for a high-gloss image output, use is made of a recording material S2 for a gloss output provided with a transparent image receiving layer 52 formed of a thermoplastic resin on one side of a sheet-like base material 51, as shown by way of example in FIGS. 3A, 3B and 3C. Such a recording material S2 for a gloss output becomes such that the surface thereof on which the image receiving layer 52 is formed generally has a uniform sense of gloss (FIG. 3A). In a special output mode, coat paper or the like can be used as the recording material S to effect an image output having a certain degree of glossiness.

In contrast, as a recording material S for a normal output mode, if a non-gloss image output is to be effected, use is made of a sheet having little or no glossiness in itself such as plain paper of a prescribed size such as A4 format or B5 format, and if a low gloss image output is to be effected, use is made of a sheet such as coat paper having a smooth surface and having a little glossiness in itself.

When the recording material S after the fixing of the low gloss or non-gloss image has been effected thereon is again fed into the fixing apparatus 1, the recording material S passes through the nip between the belt member 5 and the heating roller 6 now acting as a pressure roller, whereby it is heated and pressurized, and is conveyed while keeping close contact with the belt member 5 still after it has passed through the nip. Subsequently, the recording material S being in close contact with the belt member 5 is cooled to a predetermined temperature (60 to 80 degrees) by the cooling apparatus 7, and thereafter is stripped off from the belt member 5 on a certain region of the strip-off roller 3. Thereby, the toner image twice fixed by the fixing apparatus 1 is again fixed on the recording material S in a state in which the smooth surface of the belt member 5 has been transferred thereto and the sense of gloss has been imparted thereto. The recording material S after the fixing is discharged onto a discharge tray by a pair of discharge rollers 205.

Figure 4:
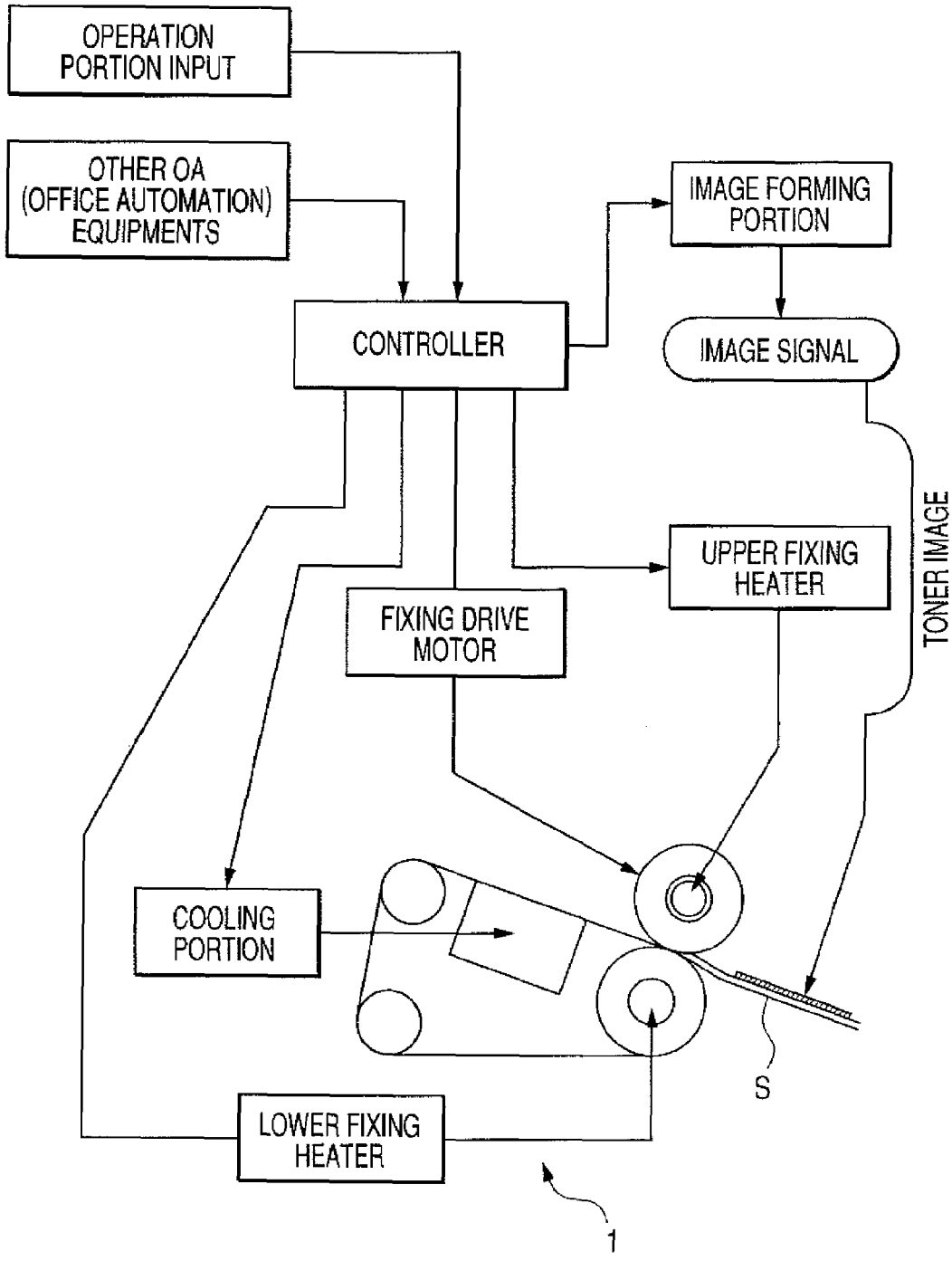
FIG. 4 is a block diagram illustrating the control system of the fixing apparatus.
Figures 5, 5A:
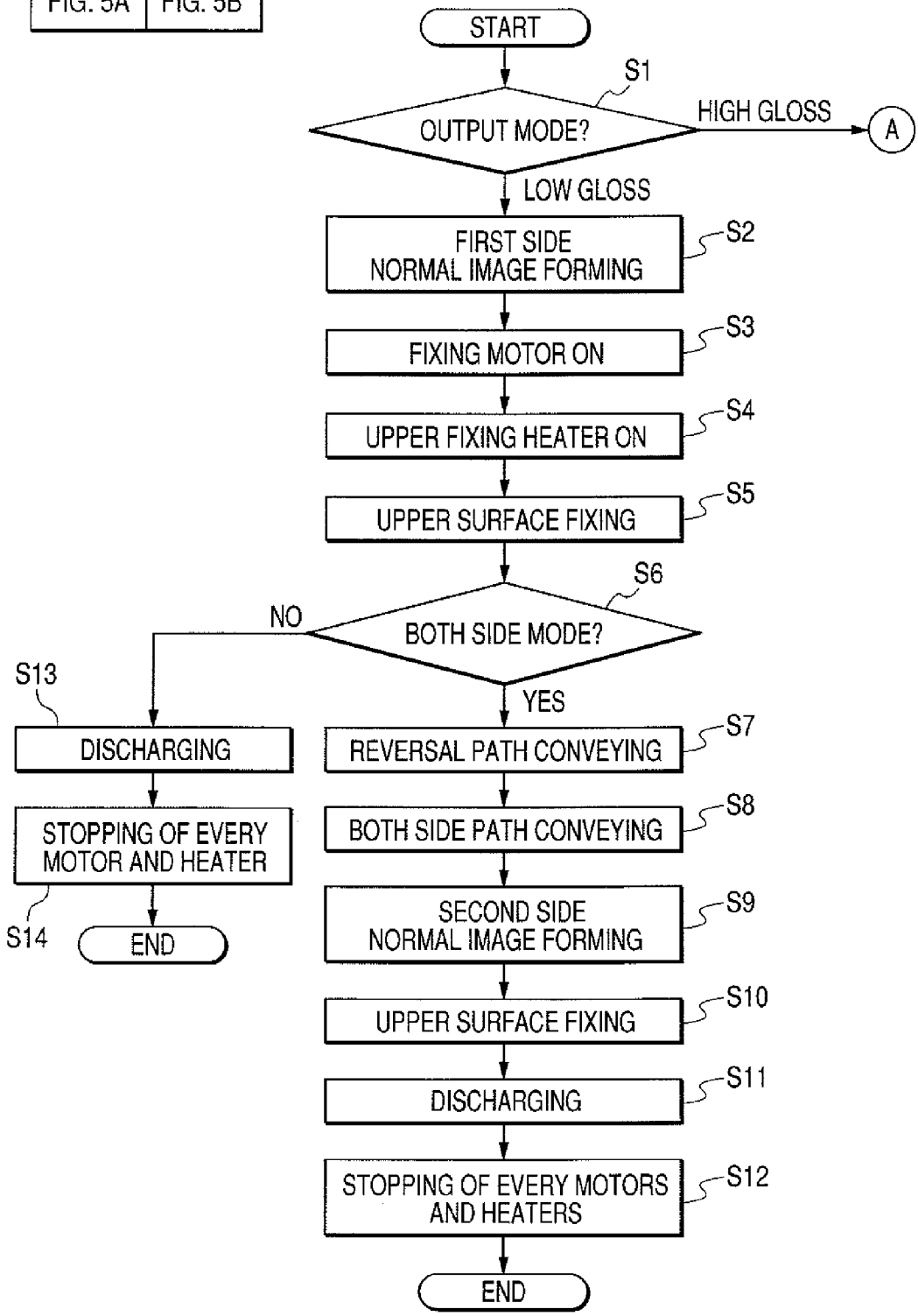
FIG. 5 is comprised of FIGS. 5A and 5B showing flow charts illustrating the control substance of the fixing apparatus.
Figure 5B:
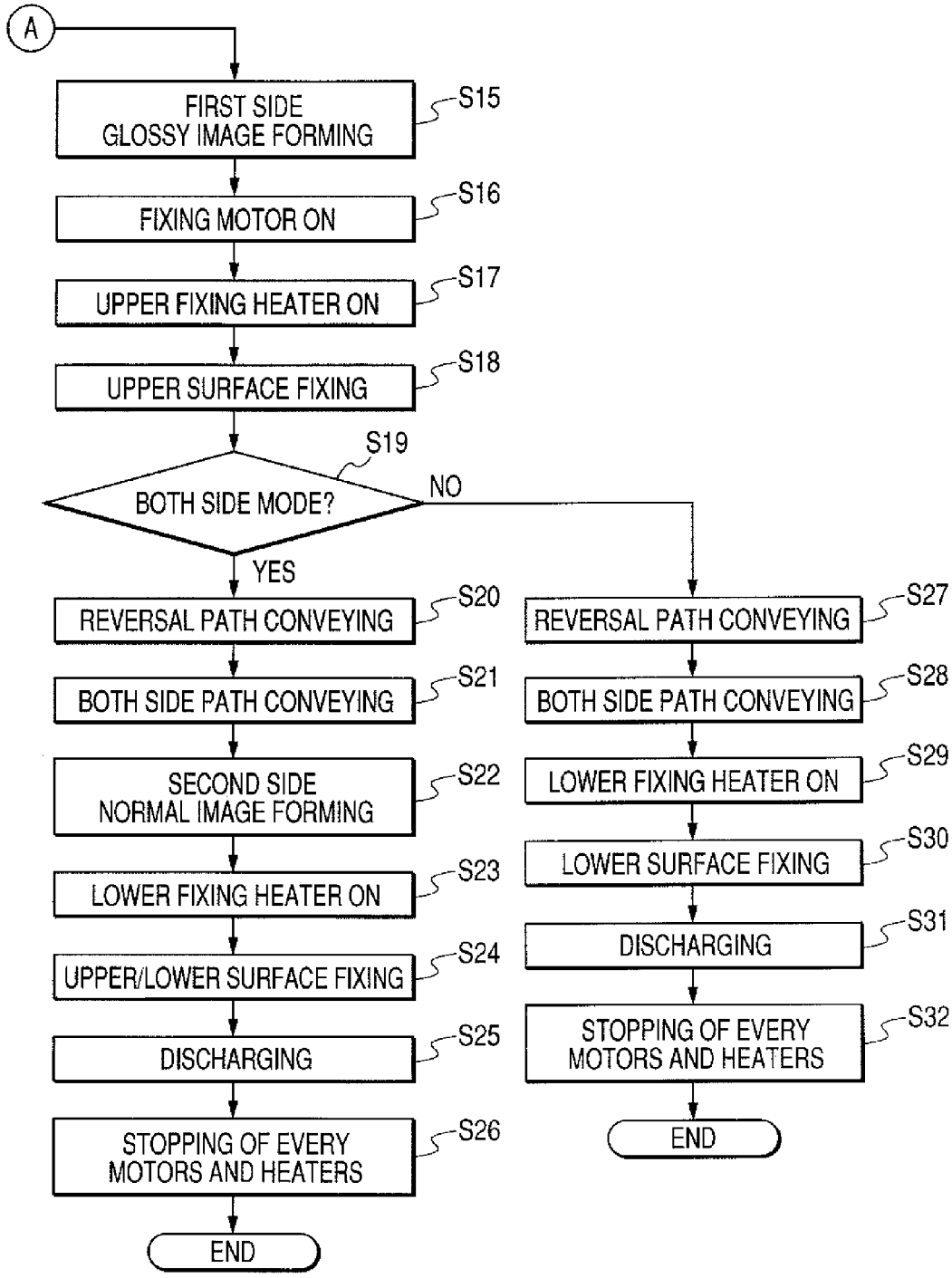
Figure 6:
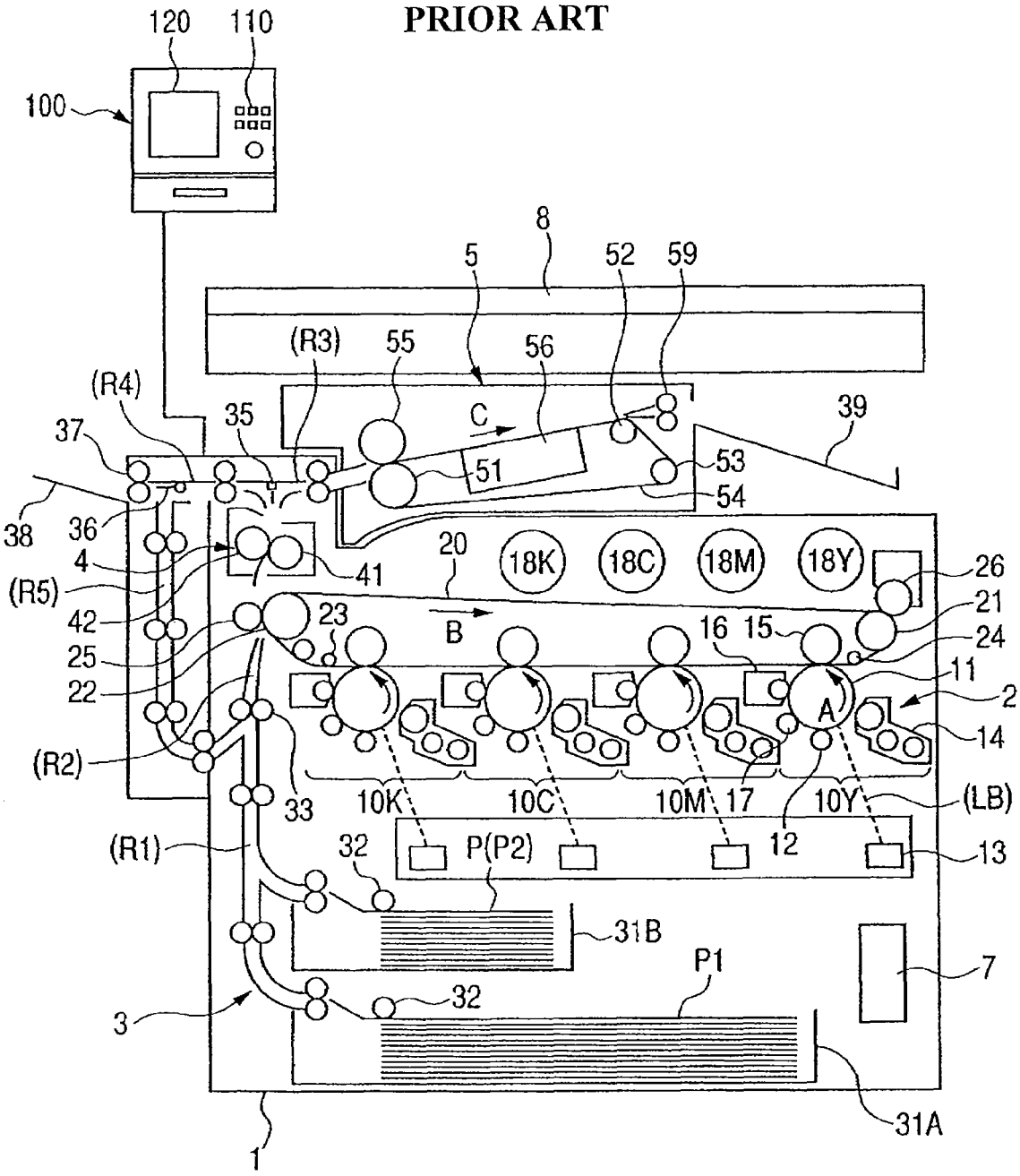
FIG. 6 PRIOR ART
FIG. 6 is a cross-sectional view of the essential portions of a conventional multi-color image forming apparatus.

FIG. 4 shows a block diagram of a control system for controlling the fixing apparatus 1. FIGS. 5A and 5B are flow charts showing the both-side image forming pattern of the image forming apparatus 200 according to the present embodiment. With reference to these figures, description will hereinafter be made of a both-side image forming mode which is a characteristic point in the present embodiment.

The controller effects the control of the entire system of the image forming apparatus, and is adapted to deliver a required control signal to the image forming portion 202, the sheet feed portion 209, the fixing apparatus 1, the image reading portion 207, the optical system 208, etc. This controller comprises a microcomputer constituted by a CPU, a ROM, a RAM, etc., and is adapted to execute a controlling operation in accordance with a control program stored in a memory such as a ROM, and the contents of selection indicating information inputted from an operation portion and other OA equipments. A control program regarding each operation which will be described later is also stored in a memory such as a ROM.

Now, the operating portion is provided with keys, etc. for inputting the setting, selection, determination and execution instructions of various conditions when the image forming apparatus is used, and is constituted together by a display portion for displaying the setting and operating state of the image forming apparatus, and the selection menu of the various conditions and inputted information or the like. The display portion may be an ordinary liquid crystal display screen or a lamp, but usually use is made of a touch panel type liquid crystal display screen which can effect the selection instructions and inputting of information in addition to the display of the information. The instruction information inputted by this operating portion is transmitted to the controller. Also, predetermined display is effected on the display portion, depending on the controlling operation of the controller and an output situation or the like from other OA equipments.

In the image forming apparatus according to the present embodiment, design is made such that as shown in FIG. 4, by effecting predetermined instructions from the operation portion and other OA equipments, one of a normal output mode for effecting an image output (copy and print) of an ordinary image quality (the image quality of low gloss and non-gloss) and a special output mode (gloss imparting mode) for effecting an image output having high glossiness imparted thereto on one side of the recording material can be selected. Also, both of the normal output mode and the special output mode are adapted to be capable of selecting one of a one-side output and a both-side output. The selection instructions at this time are effected directly with a predetermined input screen on the like being displayed from the operation portion comprising a touch panel type liquid crystal display screen, or are effected together with the use of a selection input operation from other OA equipments.

Also, in this image forming apparatus, from the viewpoint of reliably effecting an image output comprising a desired image quality, setting is made so as to use recording materials S corresponding to the above-described respective output modes.

Description will hereinafter be made of the main operations (operations at and after the image forming step) of the image forming apparatus when the aforedescribed respective output modes have been selected (please refer to FIG. 5).

When there is a demand for output from the operation or other OA equipments, the controller first effects the judgment of the output mode. For example, when a recording material S1 is fed from the sheet supplying cassette 210 containing recording materials S1 such as plain paper or coat paper therein through a sheet feeding and conveying path, the controller judges that the image to be formed is of low gloss or non-gloss (step 1). The toner image formed by the image forming portion 202 is then transferred and carried, whereby an unfixed toner image (image of non-gloss or low gloss) is formed on one side (first side) of the recording material S1 (step 2). In the meantime, the controller gives instructions for the rotation of the fixing motor and the voltage application to the halogen heater 6-1 of the heating roller 6 (steps 3 and 4). The unfixed toner image on the recording material S1 thus conveyed and fed into the fixing apparatus 1 by the transferring and conveying apparatus 222 is fixed as a permanent toner image (step 5). Subsequently, the controller judges whether the recording material S1 after this fixing of the first side is for the both-side mode (step 6). If the recording material S1 has been subjected to image forming in the both-side mode, the recording material S1 is reversed and conveyed to the reversal conveying path 101 by the reversal flapper mechanism 111 (step 7), and then is conveyed to the both-side conveying path 102 by the both-side flapper mechanism 112 (step 8).

The recording material S1 thus reconveyed by the reversal conveying path 101 and the both-side conveying path 102 is soon refed to the registration rollers 221, and a toner image is formed on a second side of the recording material S1 (step 9). The recording material S1 having had an unfixed toner image (image of non-gloss or low gloss) transferred to its second side is again fed into the fixing apparatus 1 by the transferring and conveying apparatus 222. Thus, the unfixed toner image on the second side of the recording material S1 is melted by the heat and pressure of the fixing apparatus 1 and is fixed as a permanent toner image (step 10). Then, the recording material S1 is discharged (with its image surface facing upward) by the discharge rollers 205 (step 11). Lastly, the controller instructs various motors and heaters to be stopped (step 12), thus terminating the control sequence. Thereby, images of non-gloss or low gloss are formed on both sides of the recording material S1. In the case of this both-side output, at the fixing step during image formation on each side, only one surface (heating roller 6) side of the fixing apparatus 1 heats and fixes and therefore, there is no such time loss as in a case where the recording material passes through a plurality of fixing apparatuses, and relatively quick both-side image forming is possible, and there is realized a compact image forming apparatus of low electric power consumption.

On the other hand, if return is made to the step 6 and the one-side output mode is designated in the normal output mode which comprises images of low gloss and non-gloss, the controller intactly discharges the recording material S1 by the discharge rollers 205 (step 13). Lastly, the controller instructs various motors and heaters to be stopped (step 12), thus terminating the control sequence.

In the description using the present flow chart, the recording surface of the discharged recording material S is described with respect only to the upwardly facing (face-up) mode, but when the recording material is to be discharged with its recording surface facing downward, it can be once conveyed to the reversal conveying path 101 as previously described, and then be discharged by the discharge rollers 205. From this purport, however, the direction of the recording surface of the discharged recording material S is not particularly restricted, but may be whichever direction.

Description will now be made of a case where return is made to the step 1, and the controller effects the selection of the special output mode. For example, in a case where from the sheet supplying cassette 211 containing recording materials S2 for gloss output therein, the recording material S2 is fed through a feeding and conveying path, the controller judges that the special output mode (gloss imparting mode) has been selected. Here, to cause the toner image to be transferred to the image receiving layer surface side of this recording material, it is necessary to feed the recording material S2 so that the image recording layer 52 thereof may be located on the transfer surface side, and in this image forming apparatus, it is necessary that the recording materials be contained in the sheet supplying cassette 211 with their surfaces bearing the image receiving layers 52 thereon facing downward.

Again in a case where a recording material S2 judged to be of high gloss has been conveyed to the transferring and conveying apparatus 222, a toner image formed by the image forming portion 202 is transferred to the recording material S2, and the recording material S2 is conveyed, whereby, an unfixed toner image (image for high gloss output) is formed on one side (first side) of the recording material S2 (step 15). In the meantime, the controller instructs the fixing motor to be rotated and the halogen heater 6-2 of the heating roller 6 to have a voltage applied thereto (steps 16 and 17). Thus, the unfixed toner image on the recording material S2 conveyed and fed into the fixing apparatus 1 by the transferring and conveying apparatus 222 is fixed as a permanent toner image (step 18). Subsequently, the controller judges whether this recording material S2 after the fixing of its first side is for the both-side mode (step 19). If the recording material S2 is instructed to form images thereon in the both-side mode, it is reversed and conveyed to the reversal conveying path 101 by the reversal flapper mechanism 111 (step 20), and then is conveyed to the both-side conveying path 102 by the both-side flapper mechanism 112 (step 21).

The recording material S2 thus reconveyed by the reversal conveying path 101 and the both-side conveying path 102 is soon refed to the registration rollers 221, and a toner image is formed on a second side thereof (step 22). The recording material S2 having had an unfixed toner image (image of non-gloss or low gloss) transferred to its second side is again fed into the fixing apparatus 1 by the transferring and conveying apparatus 222. In the meantime, the controller instructs the halogen heater 2-1 of the heating roller 2 for driving the belt member 5 to have a voltage applied thereto (step 23). Thus, the unfixed toner image on the second side of the recording material S2 is melted by the heat and pressure of the fixing apparatus 1 and is fixed as a permanent toner image. At this time, the fixed toner image on the first side once normally fixed is again melted on the belt member side and is pushed in, whereby the fixing of a smooth image of high gloss is realized (step 23).

Figure 3B:
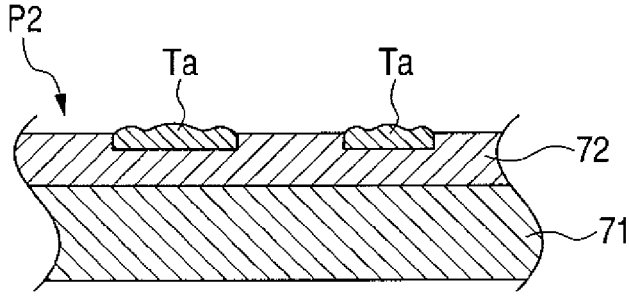
FIG. 3B is a schematic cross-sectional view showing the state after one fixing process.
Figure 3C:
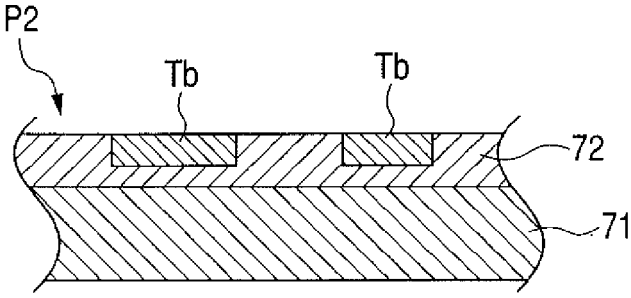
FIG. 3C is a schematic cross-sectional view showing the state after two fixing processes.

That is, at the high gloss surface side output in this special output mode, as shown in FIG. 3B previously described, the toner image is heated and melted in the first fixing and assumes a state (toner image Ta) in which it is a little buried in the surface of the image receiving surface 52 and also protrudes a little from that surface, but as shown in FIG. 3C, the toner image T1 after the first fixing is buried substantially completely in the image receiving layer 52 at the second fixing and the surface thereof assumes a smooth state (toner image Tb). This is because as shown in FIG. 2, the image receiving layer 52 of the recording material which is heated and pressurized by the heating rolls 2 and 6 in the fixing apparatus 1 and melted thereby and the toner image Ta after the first fixing which is also melted and pushed into the image receiving layer 51 are cooled by the cooling apparatus 7, whereby the whole surface of the image receiving layer 52 including the toner image Ta is solidified into a smooth surface state following the surface of the belt member 5. As the result, the formation of a photographic tone image (toner image Tb) capable of obtaining high gloss becomes possible.

Thus, he recording material S2 having had the toner images fixed on its both sides is discharged out of the image forming apparatus 200 by the discharge rollers 205 (step 24). Lastly, the controller instructs the various motors and heaters to be stopped (step 25), thus terminating the control sequence. Thereby, an image of high gloss is formed on one side of the recording material S2, and an image of non-gloss or low gloss is formed on the other side thereof. In the case of this both-side output, the fixing step during total image formation is to pass only twice through the fixing apparatus 1 and therefore, there is no such time loss as in a case where the recording material passes through a plurality of fixing devices, and relatively quick both-side image forming is possible, and there is realized a compact image forming apparatus of low electric power consumption.

Thereby, images are formed on both sides of the recording material S2 for gloss output, and particularly in this case, an image of high gloss is formed on the side thereof having the image receiving surface 52 thereon, while on the other hand, an image of non-gloss or low gloss is formed on the side thereof not having the image receiving layer 52 thereon. The both-side output in such a special output mode can be applied to such a use in which, when preparing e.g. a postcard with a photograph printed thereon like a New Year card, an image of high gloss including a photograph or the like is formed on one side thereof, while the name and address of an addressee are written and an image of non-gloss or low gloss such as the photographing information of the photograph is formed on the opposite side thereof.

Subsequently, return is made to the step 19, and when in the special output mode comprising an image of high gloss, the one-side output mode is designated, the controller does not intactly discharge the recording material S2 by the discharge rollers 205. Also, when the recording material S2 is instructed to form an image in the one-side mode, the controller reverses and conveys the recording material S2 to the reversal conveying path 101 by the reversal flapper mechanism 111 (step 27), and then conveys it to the both-side conveying path 102 by the both-side flapper mechanism 112 (step 28).

The recording material S2 thus reconveyed by the reversal conveying path 101 and the both-side conveying path 102 is soon refed to the registration rollers 221, but unlike during the both-side mode, a toner image is not formed on the second side of the recording material S2. The recording material S2 having intactly passed through the transferring portion without stopping is again fed into the fixing apparatus 1 by the transferring and conveying apparatus 222. In the meantime, the controller instructs the halogen heater 2-1 of the heating roller 2 for driving the belt member 5 to have a voltage to be applied thereto (step 29). Thus, the fixed toner image on the first side of the recording material S2 once normally fixed is again pushed into the belt member side while being melted, whereby the fixing of a smooth image of high gloss is realized (step 30).

Thus, the recording material S2 having had a smooth glossy toner image fixed on its image receiving layer 52 side is discharged out of the image forming apparatus 200 by the discharge rollers 205 (step 31). Lastly, the controller instructs the various motors and heaters to be stopped (step 32), thus terminating the control sequence. Thereby, an image of high gloss is formed on one side of the recording material S2. In the case of this one-side output, it is unnecessary to pass the recording material once through each of discrete fixing devices as in the image forming apparatus shown in the example of the prior art, but the recording material passes only twice through the fixing device 1 and therefore, such an increase in installation space and an increase in cost as in a case where the recording material passes through a plurality of fixing devices does not result, and there is realized a compact image forming apparatus of low electric power consumption.

As described above, in the image forming apparatus according to the present embodiment, the image output to the both sides of the recording sheet therein can be effected by a single image forming portion 202 and therefore, a compact and low-cost apparatus can be provided as an image forming apparatus which can effect a both-side output in which an image of high gloss is formed on one side of the recording material.

Also, it has never come to happen that as indicated in the example of the prior art, mechanism units are added to the image forming apparatus one after another, or the cost becomes higher, or the installation dimensions are increased, or the recording sheet conveying path becomes longer and the apparatus becomes inferior in the initial productivity (F-COT: first copy time). More particularly, instead of such a cumbersome construction in which not only during both-side image formation, but also during normal image quality one-side image formation, a recording sheet passes through two fixing devices disposed in series or through paths including a conveying path bypassing one of the two fixing devices, the construction of a recording sheet conveying path could be simplified and therefore, an improvement in productivity, a reduction in installation area and a lower cost could be realized.

In fact, even to a demand for an installation space and an equipment introduction cost in a copy shop or the like wherein there is a demand for printing on the back of a silver salt photograph of high gloss, it has become possible to provide an image forming apparatus of a popular price which can be compactly installed and can obtain a highly glossy image of a silver salt photograph tone and at the same time, can effect back side printing.

Thus, it has become possible to inexpensively provide a compact image forming apparatus which can well perform both-side image forming for at least forming an image of high gloss on one side of a recording sheet and forming an image of non-gloss or low gloss on the other side of the recording sheet.

Second Embodiment

A second embodiment will now be described.

Figure 8:
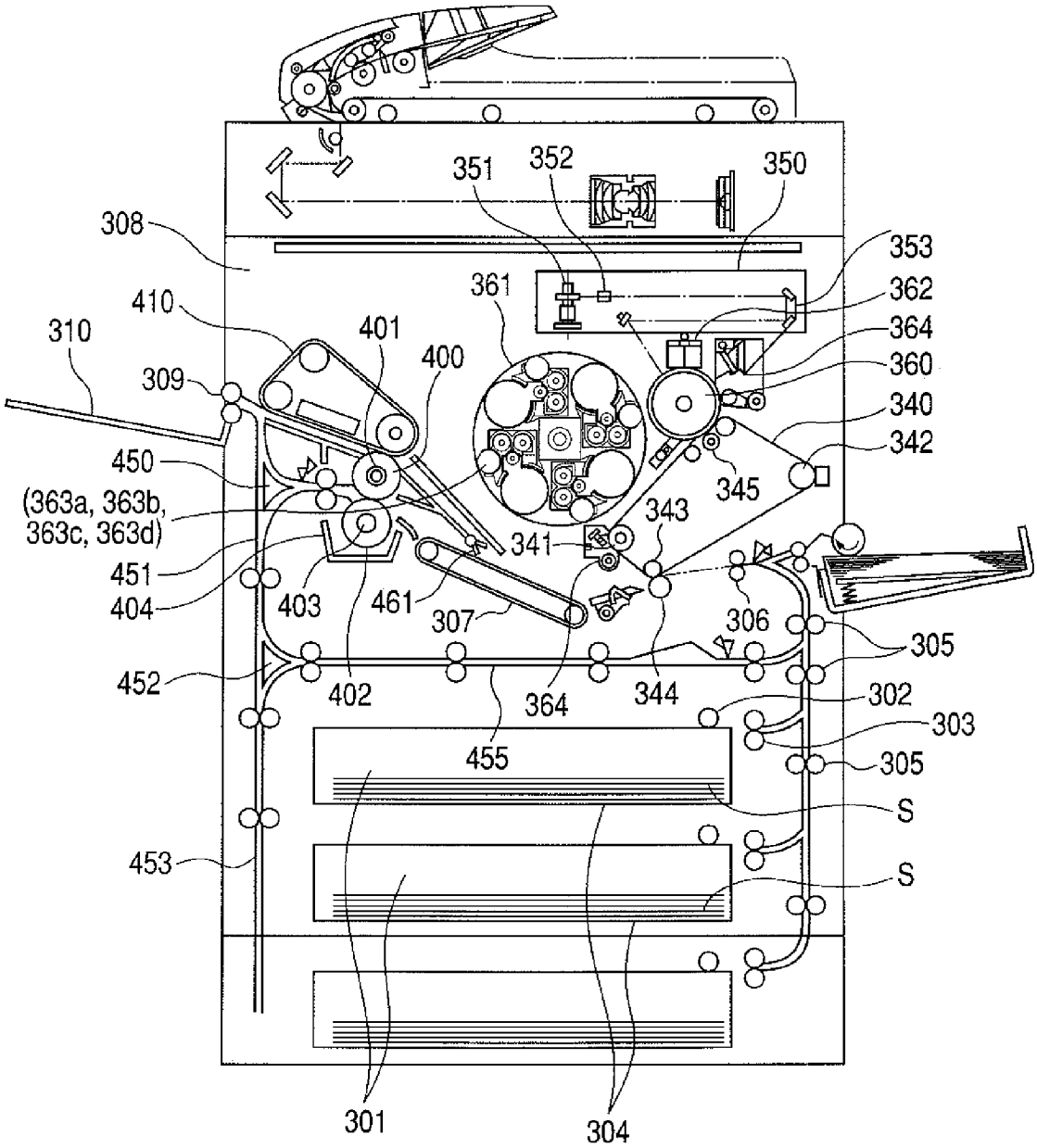
FIG. 8 is a schematic cross-sectional view of an image forming apparatus.

FIG. 8 is a cross-sectional view of the essential portions of a printer as an image forming apparatus.

Referring to FIG. 8, description will be briefly made of the epitome until a printed image is obtained.

Image information sent from a personal computer or the like is converted into an electrical signal for each color (each color station) by an image processing portion, not shown, and is transmitted to a laser scanner 350.

A laser beam corresponding to this image information for each color is emitted from the laser scanner 350, is scanned by an image signal writing-in optical system such as a rotating polygon mirror 351 and a lens 352, is turned back toward a photosensitive drum 360 by a turn-back mirror 353, and is imaged on the photosensitive drum 360 to thereby form an electrostatic latent image.

This electrostatic latent image is developed into a toner image by a rotary developing device 361. The color printer according to the present embodiment is a so-called one drum type color printer and therefore, there are installed one laser scanner 350 and one photosensitive drum 360, and when development in each color is to be effected, the rotary developing device 361 is sequentially changed over.

Around the photosensitive drum 360, there are disposed a charger 362, developing devices of respective colors (363*a*, 363*b*, 363*c*, 363*c*) constructed in the rotary developing device 361, and a photosensitive drum cleaner 364. The rotary developing device 361, as shown, is provided with a yellow (Y) developing device 363*a*, a magenta (M) developing device 363*b*, a cyan (C) developing device 363*c* and a black (Bk) developing device 363*d*.

This rotary developing device 361 is rotatable by a driving system, not shown, and can change over a developing device of a desired color to a position opposed to the photosensitive drum 360 each time and develop the latent image on the photosensitive drum to thereby obtain the desired color.

When a full-color image is to be obtained, the latent image on the photosensitive drum 360 is developed for each color, and each time, the toner image is primary-transferred onto an intermediate transfer belt 340 by a primary transfer roller 345. The operation of the image writing-in system on the photosensitive drum 360 is the same for all of yellow, magenta, cyan and black. In this manner, the rotary developing device 361 is changed over and images of the respective colors are successively superposed onto the intermediate transfer belt 340 to thereby obtain a full-color image. The intermediate transfer belt 340 is passed over such rollers as a tension roller 342, a drive roller 341 and a secondary transfer roller 343, and is clockwisely rotated as viewed in FIG. 8.

Next, recording materials are set in a sheet supplying cassette 301, which is contained in the machine. When the sheet supplying cassette 301 is set in an apparatus main body, a lifter 304 in the sheet supplying cassette 301 is lifted by a lift motor, not shown, and along therewith, the paper surface of the recording materials S is also lifted to thereby bring about a state in which the feeding of the sheets is possible. The recording materials start to be moved by the rotation of a sheet feeding roller 302, are separated one by one by a pair of separating rollers 303, and are conveyed to registration rollers 306 via a conveying roller train 305. The recording material having had its registration corrected by the registration rollers 306 is conveyed to a secondary transferring portion.

The full-color image previously formed on the intermediate transfer belt 340 is transferred onto the recording material by secondary transfer rollers 343 and 344. The recording material S onto which the image has been transferred is stripped off from the intermediate transfer belt 340 by a separating charger, not shown. Then, the recording material S is conveyed to a fixing device 308 via a conveying portion 307, and the toner image on the recording material is fixed thereon, whereafter the recording material is discharged onto a sheet discharging tray 310 outside the machine by a sheet discharging roller train 309, thus terminating a one-side printing operation.

The fixing device will now be described in detail.

Figure 7:
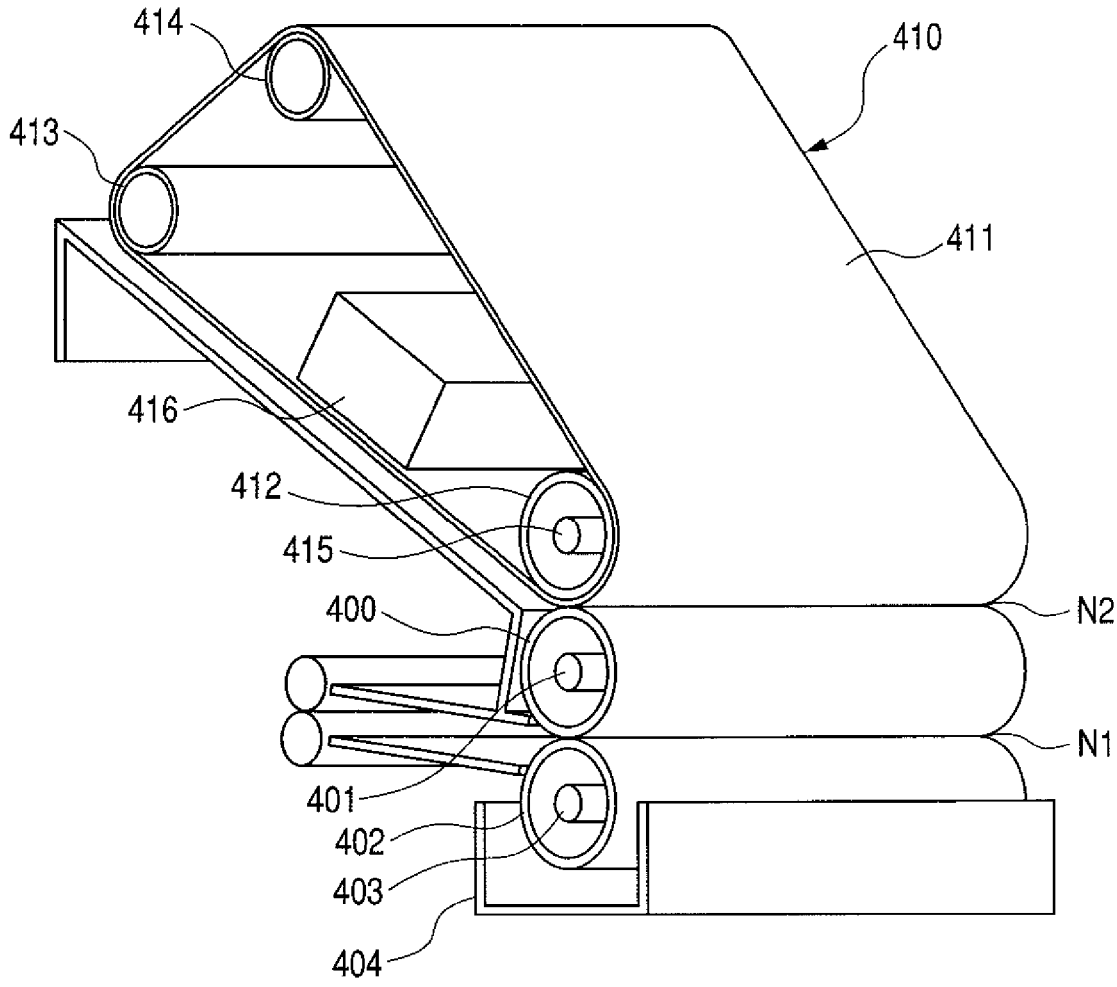
FIG. 7 is a schematic view of a fixing portion.

FIG. 7 is a perspective view of the fixing device as image heating means. A heater 401 as a heat source is provided in a fixing roller 400 as a first rotary member. Likewise, a heater 403 as a heat source is also provided in a pressure roller 402 as a second rotary member, and these two rollers as first image heating means are pressurized by springs and form a first nip N1 therebetween. A recording material separation temperature in this first nip N1 is substantially equal to a fixing temperature.

When a normal non-gloss image or a low-gloss image is to be formed, the recording material is passed only once through this first nip N1.

On the other hand, one more image heating mechanism 410 is installed on top of the fixing roller 400. Specifically, an endless belt 411 as a third rotary member is installed on top of and in contact with the fixing roller 400, and the fixing roller 400 and the belt 411 as second image heating means are pressed against each other to thereby form a second nip N2.

A lower cover 404 is disposed under the pressure roller 402. In the present embodiment, the heating and pressure member 410 is made detachably mountable with respect to the fixing roller 400 and the pressure roller 402.

On the other hand, when it is desired to increase the degree of gloss of a graphic image such as a photograph or an output image, the recording material is heated by the first nip N1, and thereafter is reheated by the second nip N2.

Figure 10:
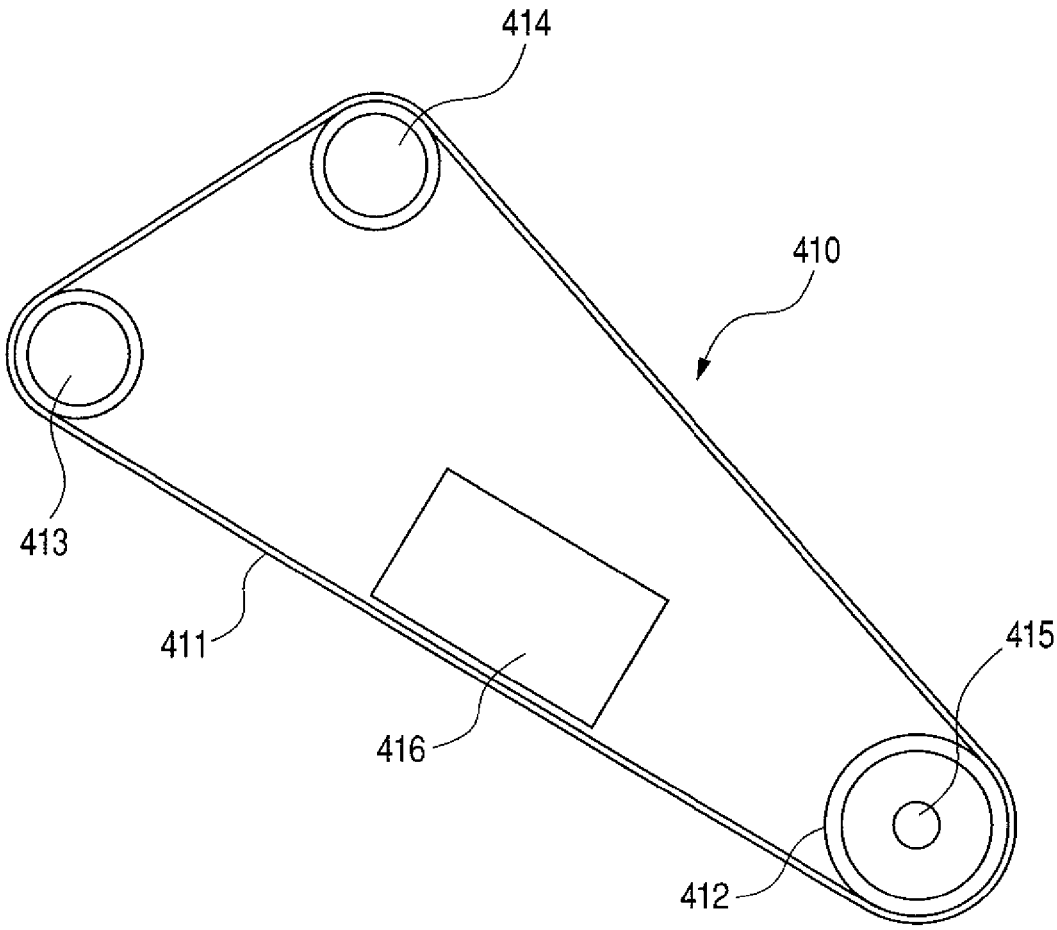
FIG. 10 is a detailed view of a heating and pressure portion.
Figure 11:
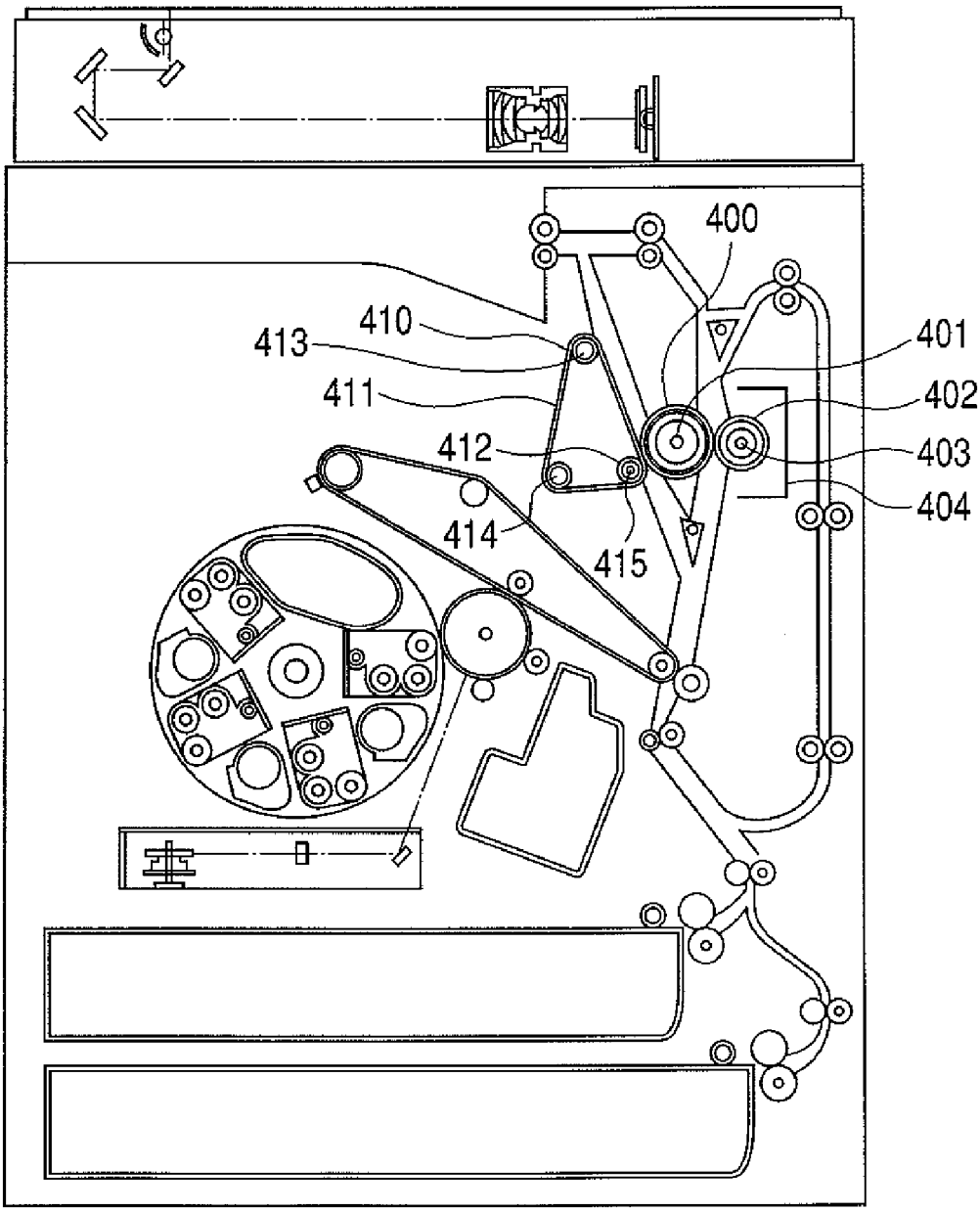
FIG. 11 is a schematic cross-sectional view showing a modification of the image forming apparatus.

The construction of the image heating mechanism 410 will hereinafter be described in detail with reference to FIG. 10.

The fixing belt 411 is passed over three rollers, i.e., a heating roller 412, a separating roller 413 and a tension roller 414. A heater 415 is contained in the heating roller 412. The heating roller 412 is clockwisely rotatively driven as viewed in FIG. 10 by a driving portion, not shown.

Consequently, the fixing belt 411, the separating roller 413 and the tension roller 414 are also rotated in the same direction. Inside the fixing belt 411 and between the heating roller 412 and the separating roller 413, there is provided cooling means 416 for cooling the fixing belt 411 and the recording material therethrough.

By such cooling means, the recording material separation temperature in the second nip N2 is made sufficiently lower than the recording material separation temperature in the first nip N1.

Specifically, according to the inventors' study, assuming that the glass transition point temperature of the toner is Tg, the recording material separation temperature in the second nip N2 could be set to (Tg+10) degrees or lower to thereby obtain a good high-gloss image.

This image heating mechanism 410, as shown in FIG. 7, is installed with the heating roller 412 brought into pressure contact with the fixing roller 400 at a position opposed to the pressure roller 402 with the fixing belt 411 interposed therebetween. This pressure means, like the pressure means for the fixing roller 400 and the pressure roller 402, is provided by a spring, not shown.

In the present embodiment, the fixing belt 411 uses an endless belt made of polyimide as a base material, and the outer surface thereof contacting with the recording material is provided with a mold releasing layer so that the smoothness of the surface may be high and the recording material may be easily separated.

Description will now be made in detail of recording material conveying paths on the recording material entrance side and exit side of the fixing device.

Figure 9:
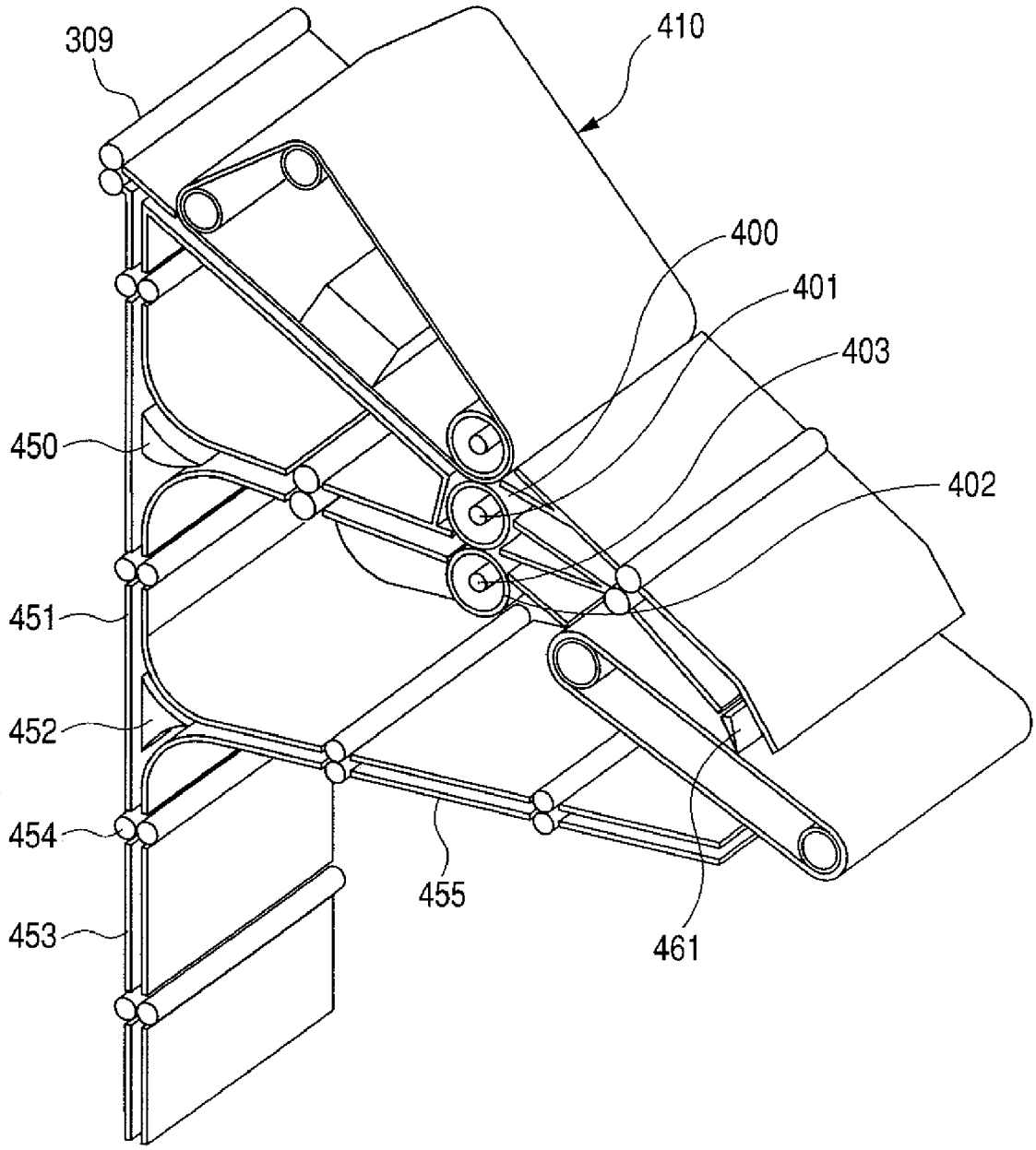
FIG. 9 is a detailed view of recording material conveying paths around a fixing device.

FIG. 9 is a detailed view of the recording material conveying paths around the fixing device. When one-side printing of a text image or a normal color image is to be effected (a first fixing mode), fixing is effected by the first nip N1 formed by and between the fixing roller 400 and the pressure roller 402. Downstream of the fixing device, there is provided a flapper 450 which is conveying path changeover means. In the case of one-side printing, the distal end portion of the flapper 450 which is adjacent the fixing device faces downward, and the recording materials pass through the fixing device, and thereafter pass a sheet discharging and conveying path 311, are discharged out of the machine by sheet discharging rollers 309, and are successively stacked on the sheet discharging tray 310.

Description will now be made of a case where a high-gloss image is formed on one side of the recording material and a low-gloss image is formed on the other side of the recording material (both-side mode), and a case where a high-gloss image is formed on one side of the recording material (special one-side mode). In these cases, the initial movement of the sequence is similar to that in the first fixing mode. In these cases, the distal end portion of the flapper 450 which is adjacent to the fixing device is changed over so as to face upward. The recording material of which the fixing of one side has been terminated in the above-described first fixing mode is conveyed to a circulating and both-side conveying path 451 by the flapper 450. The circulating and both-side conveying path 451 is further provided with a flapper 452 which is conveying path changeover means.

When both-side printing is to be effected on the recording material, it is necessary to reverse the front surface and rear surface of the recording material and therefore, the upper distal end portion of the flapper 452 is rightwardly inclined as viewed in FIG. 9. Thus, the recording material is directed to a reversal conveying path 453 and the entire recording material is contained in this reversal conveying path 453, whereafter a conveying roller 454 is once stopped, and then is rotated in a reverse direction to thereby convey the recording material again to the circulating and both-side conveying path 451.

The recording material having had its front surface and rear surface thus reversed is again conveyed to the registration rollers 306, and has its registration corrected thereby, and thereafter is conveyed to the secondary transferring portion, whereby an image is formed on the rear surface thereof. After the image has been formed, the recording material again passes through the first nip N1 formed by and between the fixing roller 400 and the pressure roller 402. At this time, the distal end portion of the flapper 450 which is adjacent to the fixing device faces downward, and then the recording material is discharged out of the machine as in the case of one-side printing.

Description will now be made of the conveyance of the recording material in a case where it is desired to obtain an output of high gloss (special one-side mode). The recording material on one side of which the image has been formed in the secondary transferring portion is subjected to the first fixing in the first nip. The recording material subjected to the first fixing is conveyed to the circulating and both-side conveying path 451 by the flapper 450. The upper distal end portion of the flapper 452 which lies on the circulating and both-side conveying oath 451 is now leftwardly inclined as viewed in FIG. 9. When in this state, the recording material is conveyed, the recording material is in a state in which the front surface and rear surface thereof are not reversed when the recording material has again arrived at the registration rollers 306. Next, in the secondary transferring portion, the toner image need not be transferred to the recording material and therefore, the intermediate transfer belt 340 and the secondary transfer roller 343 are spaced apart from the secondary transfer roller 344 by a cam mechanism or the like, not shown, and the recording material is conveyed by a conveying roller, not shown, which replaces them. If at this time, the intermediate transfer belt 340 is cleanly cleaned, the recording material may be conveyed by the secondary transfer rollers 343 and 344.

Downstream of the intermediate transfer belt 340, there is further provided a flapper 461 which is conveying path changeover means. This flapper 461 normally has its right distal end portion as viewed in FIG. 9 facing upward, and is adapted to convey the recording material to the first nip N1 during normal printing such as one-side printing (first fixing mode).

When an image of high gloss is to be outputted (special one-side mode), the right distal end portion of this flapper 461 is set so as to face downward. The recording material having passed the secondary transfer rollers 343 and 344 is directed to the second nip N2 formed by the fixing roller 400 and the image heating mechanism 410, by the flapper 461.

The fixing roller 400 is designed to be rotatable in forward and reverse directions by a driving portion, not shown. The pressure roller 402 is designed to be capable of being spaced apart from the fixing roller 400 by a cam member, not shown. Alternatively, the pressure roller 402, like the fixing roller 400, may also be designed to be rotatable in forward and reverse directions. The heater 403 is installed in the pressure roller 402, and this may be used an external heating roller for the fixing roller 400. This is used as an auxiliary heat source for suppressing the sudden fall of the temperatures of the portions of the fixing roller 400 and the fixing belt 411 on which the recording material has passed which is caused particularly when the recording material is a recording material of a small size such as a postcard. As the effects by this, mention may be made of an improvement in the productivity of the image forming apparatus, an improvement in the life of constituent parts, etc. which are brought about by the temperature fall of the rollers.

In the case of the present embodiment, when the fixing of the toner image on the recording material is to be effected in the second fixing mode, the fixing roller 400 is rotated in a counter-clockwise direction as viewed in FIG. 9.

Since the heater 413 is contained in the heating roller 412 of the image heating mechanism 410, the toner image on the recording material is again melted thereby. The fixing belt 411 is provided with a mold releasing layer of high smoothness on the surface thereof and therefore, the remelted toner image passes through the second nip N2 with the surface property of the fixing belt 411 transferred thereto. The toner image on the recording material immediately after it has passed through the second nip N2 is still in its molten state and therefore, the recording material is conveyed by the fixing belt 411 while keeping close contact with the surface of the fixing belt 411 due to the viscosity thereof. The cleaning means 416 is provided inside the fixing belt 411 and between the heating roller 412 and the separating roller 413.

The recording material is cooled there from its image surface side through the fixing belt 411. The recording material is conveyed by the fixing belt 411 while being cooled, and in a state in which the toner image thereon has been solidified, the recording material is conveyed to the separating roller 413, and is separated from the fixing belt 411 by this separating roller 413.

The recording material is conveyed and cooled in a state in which as described above, the molten toner surface is brought into close contact with the surface of the fixing belt 411 having high smoothness, and is separated from the fixing belt 411 after the toner image has been solidified, whereupon the high smoothness of the fixing belt 411 is transferred to the image surface of the recording material, whereby an output image of high glossiness can be obtained.

Thereafter, the recording material separated by the separating roller 413 is discharged out of the machine by the sheet discharging rollers 309 as during the normal operation.

After it has passed through the first nip N1 in this manner, the recording material passes the circulating and conveying path, and has the toner image thereon fixed again in the second nip N2, and has transferred thereto the surface property of the fixing belt 411 having good smoothness, and is cooled and separated (second fixing mode), whereby the outputted recording material can obtain thereon an image having high glossiness and very much suited for a graphic image such as a photograph.

As previously described, in the construction which is the basis of the present image forming apparatus, design is made such that the fixing of the recording material is effected by the use of the first nip N1 in the first fixing mode, and is effected by the use of both of the first nip N1 and the second nip N2 in the second fixing mode. If a user requires only the output of a text image chiefly such as a writing, or a color image of which the degree of gloss is relatively not required, a simple construction in which an upper fixing cover is disposed can be selected instead of the image heating mechanism 410 forming the second nip N2. If it is desired afterward to output a graphic image such as a photograph, only the image heating mechanism 410 can be purchased and interchanged with the upper fixing cover. In the conventional image forming apparatus, it has been necessary to change the image forming apparatus itself by purchase if the image forming apparatus itself does not cope with those images.

Even if there are prepared such options as can be adopted afterward, many of those options are designed to singly form a fixing device, and have been expensive. Further, usually many of such options are mounted on the outside of the main body of an image forming apparatus and it is necessary to secure an installation space therefor, and it has been necessary for the user to provide a great cost and a large installation space. In the present embodiment, it is possible to minimize such a user's burden.

Third Embodiment

Second Embodiment has been shown as an embodiment of an image forming apparatus of a so-called face-up sheet discharge type in which during one-side printing, the recording material is discharged with its image surface facing upward.

This third Embodiment is shown as an embodiment of an image forming apparatus of a so-called face-down sheet discharge type in which during one-side printing, the recording material is discharged with its image surface facing downward.

Even in such a construction, a construction similar to that of second Embodiment can of course be applied thereto to thereby obtain an effect similar to that of second Embodiment.

This application claims priority from Japanese Patent Application Nos. 2004-360035 filed on December 13, 2004 and 2004-361485 filed on December 14, 2004, which are hereby incorporated by reference herein.

What is claimed is:

1. An image forming apparatus comprising:

image forming means for forming a toner image on a recording material;

image heating means for heating the toner image on the recording material, said image heating means having first image heating means provided with a first rotary member and a second rotary member forming a first nip therebetween, and second image heating means provided with a third rotary member forming a second nip between it and said first rotary member and said first rotary member, said second rotary member and said third rotary member respectively has a heater; and means for introducing the recording material heated in said first nip into said second nip;

wherein a recording material separation temperature of said second image heating means is lower than the recording material separation temperature of said first image heating means, wherein, when the toner image is heated in said second nip, said second rotary member heats said first rotary member, and wherein said image forming apparatus is operable in a mode for forming a high-gloss toner image on a first side of the recording material and a low-gloss toner image on a second side of the recording material, by introducing the recording material having a toner image formed on the first side thereof into said first nip, and thereafter introducing the recording material having a toner image formed on the second side thereof into said second nip.

2. An image forming apparatus according to claim 1, wherein said third rotary member has an endless belt passed over a plurality of suspension members.

3. An image forming apparatus according to claim 2, wherein said second image heating means has cooling means for cooling the recording material moving while keeping contact with said belt before the recording material is separated from said belt.

4. An image forming apparatus according to claim 1, wherein each of said first rotary member and said second rotary member has a roller.

5. An image forming apparatus according to claim 1, wherein a rotating direction of said first rotary member when the toner image is heated in said second nip is contrary to a rotating direction of said first rotary member when the toner image is heated in said first nip, and wherein a rotating direction of said second rotary member when the toner image is heated in said second nip is contrary to a rotating direction of said second rotary member when the toner image is heated in said first nip.

* * * * *